United States Patent [19]

Aronson

[11] Patent Number: 4,613,077

[45] Date of Patent: Sep. 23, 1986

[54] PROGRAMMABLE SPRINKLER

[76] Inventor: Jeffry D. Aronson, 6721 Craig St., Fort Worth, Tex. 76112

[21] Appl. No.: 598,529

[22] Filed: Apr. 9, 1984

[51] Int. Cl.[4] ..... B05B 3/04

[52] U.S. Cl. ..... 239/97; 239/236; 239/240; 239/DIG. 1

[58] Field of Search ..... 239/DIG. 1, 69, 97, 239/236, 240–242

[56] References Cited

U.S. PATENT DOCUMENTS

| | | | |
|---|---|---|---|
| 2,693,390 | 11/1954 | Spender et al. | 239/DIG. 1 X |
| 2,780,488 | 2/1957 | Kennedy | 239/240 X |
| 2,835,529 | 5/1958 | Egly et al. | 239/DIG. 1 X |
| 2,962,220 | 11/1960 | Woods | 239/236 X |
| 3,645,451 | 2/1972 | Hauser | 239/242 X |
| 3,952,954 | 4/1976 | Taylor | 239/DIG. 1 X |
| 3,960,327 | 6/1976 | Olson | 239/DIG. 1 X |
| 4,186,880 | 2/1980 | Jacobi et al. | 239/DIG. 1 X |
| 4,253,608 | 3/1981 | Hunter | 239/242 X |

*Primary Examiner*—Joseph F. Peters, Jr.
*Assistant Examiner*—Mary Beth Jones
*Attorney, Agent, or Firm*—Peter J. Murphy

[57] ABSTRACT

A sprinkler body, to be anchored in the ground or to some structure, includes a chamber and a fluid inlet to the chamber. A rotatable head assembly mounted on the body includes a ring gear within the chamber and an external head with a laterally directed nozzle for directing a stream of fluid to cover a selected area around the sprinkler. A fluid operated motor within the body chamber, driven by the fluid passing through the sprinkler, drives the ring gear through reduction gearing. A Variable flow control valve consists of a slide mounted in the head for controlling the flow of fluid to the nozzle. A programmed cam is mounted on the body and a cam follower mounted on the valve slide follows the cam to vary the valve opening in relation to the rotational position of the head relative to the body. The valve controls the volume and throw of the fluid stream so that the sprinkler covers uniformly an area of irregular noncircular configuration. Motor fluid for the motor bypasses the valve to provide constant rotational speed of the head assembly. For a remote control sprinkler, a rotary valve in the body inlet may be operated by an electric motor, and a coacting index mechanism between the body and head, signals to the control mechanism the rotational position of the head relative to the body.

7 Claims, 10 Drawing Figures

PROGRAMMABLE SPRINKLER

This invention relates to a sprinkler, for lawns or other purposes, for applying a uniform amount of fluid to an area having an irregular, non-circular periphery; and more particularly to a rotary sprinkler for sweeping an area with a stream of fluid, and for projecting that stream to a selected varying periphery of the swept area.

A disadvantage of known lawn sprinklers is that the fluid spray is projected in a circular (or partially circular) pattern. Where a large area of lawn is to be covered by multiple sprinklers, the circular spray patterns of the several sprinklers must necessarily overlap, resulting in a non-uniform application of water to the lawn area. Another disadvantage of these circular sprinklers is that it is practically impossible to adapt them to areas which are substantially non-circular, such as relatively narrow rectangular areas, L-shaped areas, or areas of any irregular shape, without the deposit of water to unwanted areas which is wasteful and possibly damaging to adjacent structures.

An object of this invention is to provide a fluid sprinkler for distributing fluid over an area having a selected irregular configuration.

Another object of this invention is to provide such fluid sprinkler which will distribute fluid uniformly over an area of selected configuration wherein the edges of the area may vary widely in distance from the sprinkler.

A further object of this invention is to provide such fluid sprinkler which is self-contained and which is automatic in operation.

Still another object of this invention is to provide such sprinkler which may be readily adjusted or programmed to enable the changing of the selected area configuration to be covered by the sprinkler.

A still further object of this invention is to provide such fluid sprinkler enabling a plurality of such sprinklers to be used to cover a large area without overlap of the areas covered by adjacent sprinklers.

Another object of this invention is to provide such fluid sprinkler enabling the exclusion of fluid coverage from a selected portion of the normal sprinkler area.

A further object of this invention is to provide such fluid sprinkler which can be controlled remotely to select or change the periphery of the fluid distribution area.

These objects are attained in a sprinkler which comprises a body having a chamber and a fluid inlet passage to that chamber, and a head rotatably mounted on that body and communicating with the chamber. The head has nozzle means for directing a fluid stream laterally relative to the axis of head rotation, and includes passage means communicating the nozzle means with the body chamber. Drive means for rotating the head relative to the body includes a fluid actuated motor disposed within the body chamber. The sprinkler includes control valve means for varying the flow of fluid to the nozzle means, and also includes means responsive to the rotation of the head relative to the body for operating that control valve means. More particularly the control valve operating means may consist of coacting cam means on the body and the head. Still more particularly the control valve means may be electrically operated and controlled by a remote control means; and the body and head may include coacting signaling means for signaling the relative rotational position of the head relative to the body.

The novel features and the advantages of the invention, as well as additional objects thereof, will be understood more fully from the following description when read in connection with the accompanying drawings.

DRAWINGS

DESCRIPTION OF THE PREFERRED EMBODIMENTS

Figure 1:
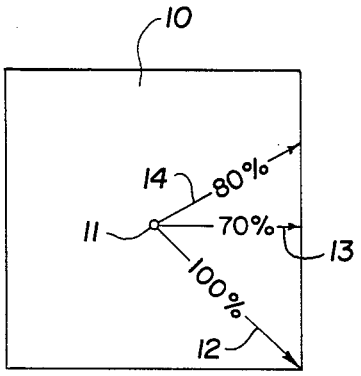
FIGS. 1 and 2 are diagrammatic views of lawn areas of different configurations to be watered by a sprinkler according to the invention.
Figure 2:
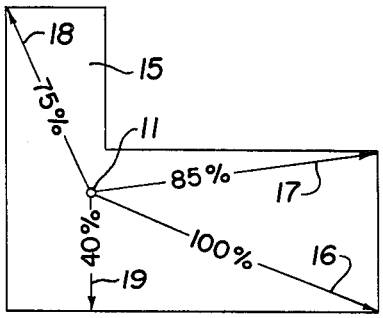

FIGS. 1 and 2 of the drawing illustrate two possible configurations of a lawn area which could be watered by a single sprinkler according to the invention, and over which the water dispensed by the sprinkler would be spread fully and quite uniformly. Assuming, of course, that the area in question is within the range of the sprinkler, the sprinkler will project the water to the edges of the lawn area with little or no overlap to adjacent areas. FIG. 1 of the drawing illustrates a square area 10 of lawn; and this could be an isolated area of lawn or it could be one portion of a large expanse of lawn which would be watered by a plurality of sprinklers according to the invention arranged in a grid pattern. A sprinkler 11 is located at the center of the lawn area 10; and the size of the area 10 would be selected and designed such that the corner of the square lawn area would be reached by the water projected from the sprinkler at 100% of flow capacity. This distance is represented by the arrow 12 in FIG. 1. The shortest distance from the sprinkler to an edge of the square pattern, represented by the arrow 13, is about 70% of the maximum distance; and accordingly if the water volume dispensed from the sprinkler head is reduced to about 70% the water will be projected to that edge line and the volume will be accordingly reduced since the area to be watered is less. If a rotating sprinkler head can be controlled then to vary the water dispensed in terms of both volume and projecting force, the square area of lawn can be watered in a uniform manner with the water being projected only to the edges of the selected lawn area.

FIG. 2 of the drawing illustrates an L-shaped lawn area 15 with a sprinkler 11 located in a manner to project water to all portions of the lawn area. The arrows 16 through 19 in FIG. 2 represent the variable water volume required to reach the irregular edges of this lawn area which are 100%, 85%, 70% and 40% respectively.

EMBODIMENTS OF FIG. 3

Figure 3:
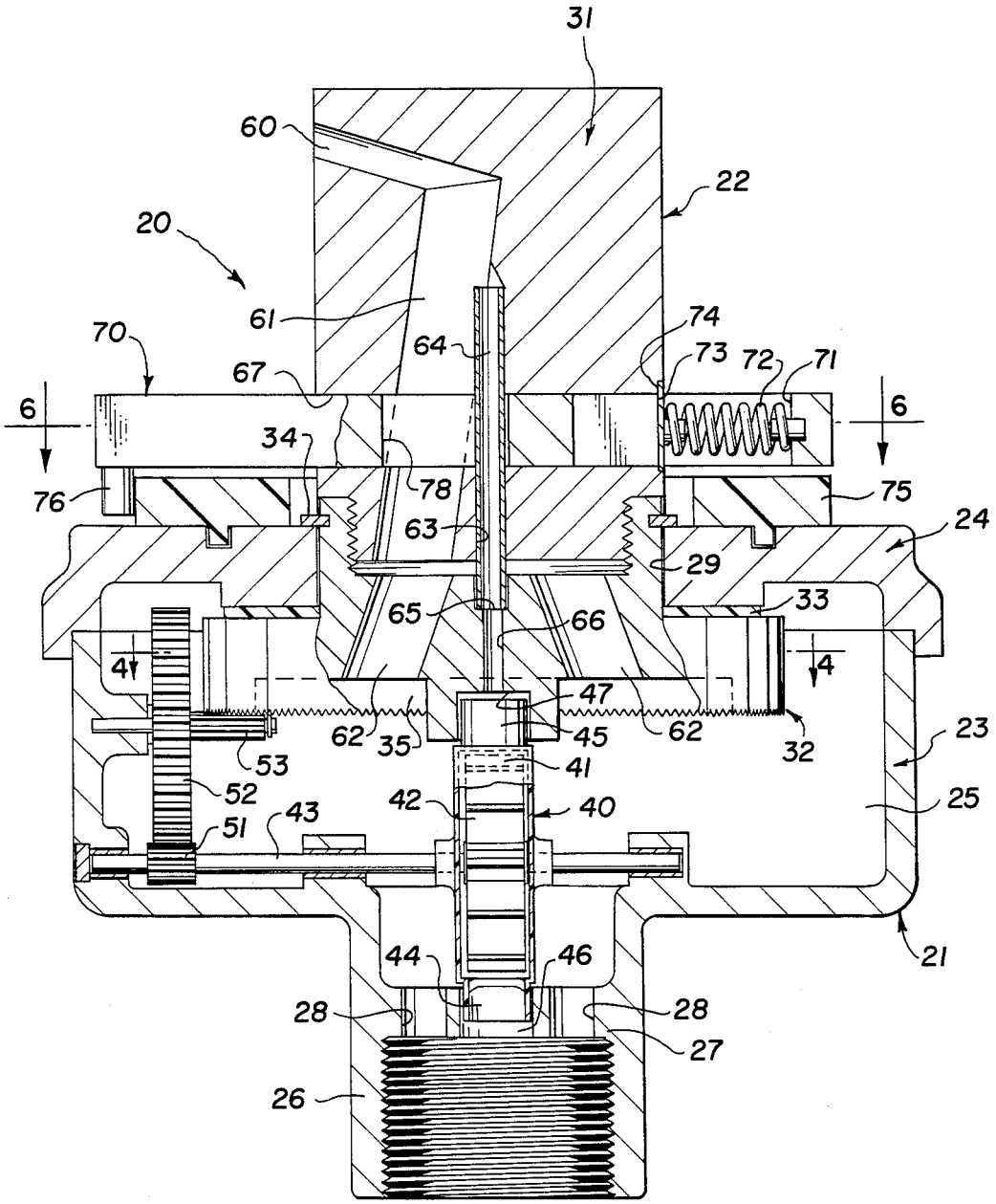
FIG. 3 is a longitudinal sectional view of one form of sprinkler according to the invention.

FIGS. 3 to 7 illustrate one preferred form of sprinkler 20 according to the invention. As best seen in FIG. 3 the sprinkler 20 consists basically of a body 21 and a head assembly 22 which is rotatable relative to the body about a vertical axis. The body consists of a lower housing 23 and an upper housing 24 defining an interior chamber 25. A neck 26 projects downwardly from the lower body 23, and is internally threaded to enable the mounting of the body 21 on a threaded water supply pipe or other water supply conduit. In use, the sprinkler body 21 must be mounted in a manner that it will not rotate. In a permanent installation the body may be recessed in the ground and connected to a fixed water supply pipe (not shown). The design may be such that the body will pop up out of a ground recess when the supply water is turned on. Alternatively, the body 21 may be provided with a downwardly projecting stake or stakes by which it may be anchored to the ground; and the neck 26 may be provided with suitable internal threads to enable the coupling thereto of a water supply hose. Another alternative is that the sprinkler may be designed to simply rest on the lawn, wherever placed, and be provided with a hose connection.

The neck 26, which provides the inlet passage to the chamber 25, is bridged by a support wall 27 the purpose of which will be described; and a plurality of passages 28 are provided in this support wall to enable water flow into the chamber 25.

The head assembly 22 consists basically of a head 31 and a head gear 32, threaded together to be rotated as a unit. The lower portion of the head gear is located within the chamber 25; and an upper head portion of the head gear extends through an opening 29 in the upper body housing 24. A bearing washer 33, fabricated of nylon for example, is disposed between a confronting upper surface of the head gear and downward facing surface of the upper body 24 to allow for relative rotation of these parts; and the head gear is retained in the upper body by means of a retaining ring 34 for example. A downward facing annular peripheral flange of the head gear defines a ring gear 35 having downward facing gear teeth, enabling rotary drive of the head assembly 22 by a drive mechanism to be now described.

Figure 5:
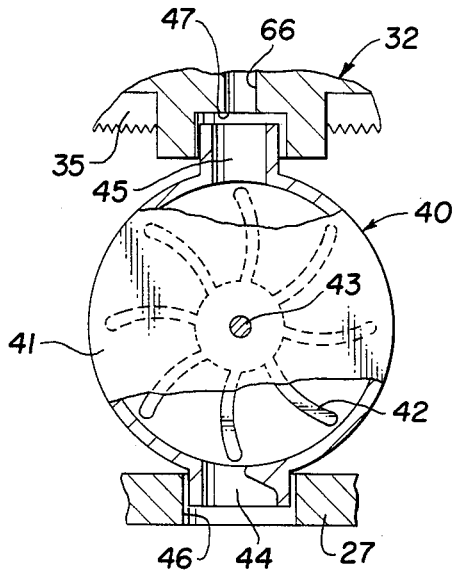
FIG. 5 is a fragmentary view, partially in section, of the motor housing and motor of FIG. 1, and the support structure therefor.

The drive mechanism includes a water operated motor 40 and an associated reduction gear mechanism for driving the head gear 32. As best seen in FIGS. 3 and 5, the motor 40 consists of a housing 41 enclosing an impeller 42 nonrotatably fixed to a drive shaft 43 which projects from both sides of the housing 41 and is rotatably supported within suitable bearings in the lower housing 23. The motor housing 41 includes a lower inlet boss 44 and an upper outlet boss 45 providing respective inlet and outlet passages for water flow through the housing to rotate the impeller 42 in one direction. The lower boss 44 seats within a passage 46 provided in the support structure 27 of the lower housing neck 26, whereby it is communicated with the water flowing into the body chamber 25. The upper boss 45 is received and confined within a downward facing recess 47 at the rotational axis of the head gear 32. This provides support for the motor housing 41 and allows rotation of the head gear relative to the motor housing. A suitable bushing may be provided between the head gear and the boss 45.

The reduction gear mechanism consists of a pinion 51 nonrotatably fixed to the shaft 43, which meshes with the larger gear 52 of a combination gear, the smaller gear 53 of which meshes with the ring gear 35. Through this reduction gear mechanism, the ring gear 35 is driven at a much lower rate of speek than the motor impeller 42.

Figure 4:
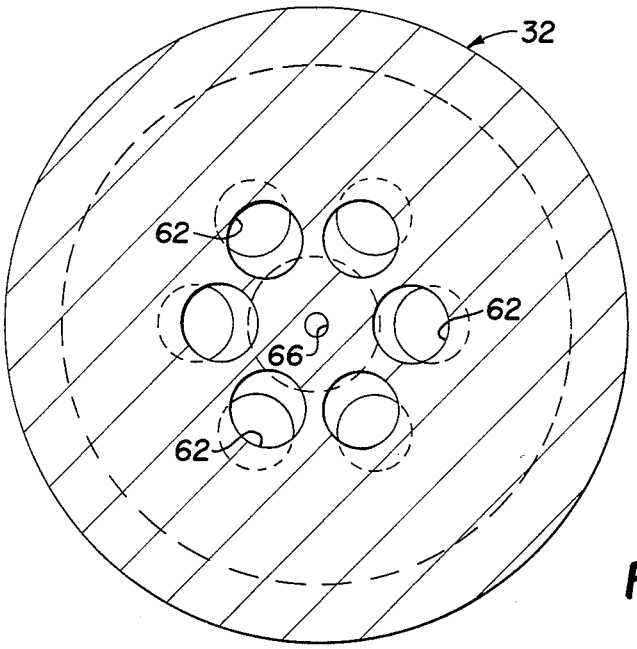
FIG. 4 is a sectional view of the head gear of the sprinkler of FIG. 3, taken along the line 4—4 of FIG. 3.

The head 31 includes a laterally and upwardly directed discharge passage defining a nozzle 60 for directing a stream of water laterally relative to the axis of rotation of the head assembly 22. This nozzle is supplied by a generally vertical passage 61 extending through the head 31 and by a plurality of generally vertical passages 62 extending through the head gear 32, as best seen in FIGS. 3 and 4. The plurality of passages 62 are provided to assure substantial registry of one of the passages 62 with the passage 61. The head 31 is also provided with a smaller axial passage 63, opening at its upper end to the passage 61, and containing a section of tubing or small pipe 64. The lower end of this tubing 64 is received fairly snugly within a central recess 65, which recess is connected with the lower head gear recess 47 by an axial passage 66 of relatively small cross section. The passages 63 and 66 and the tubing 64 provide a restricted flow passage between the water operated motor 40 and the nozzle 60 to allow for drive of the motor 40 independently of the valve mechanism, to be described, for varying the flow of water which is dispensed from the nozzle 60. The water available at the housing neck 26 enters the motor housing 41 through the inlet 44, and is discharged from the motor housing through the outlet 45, the recess 47 and the above described restricted flow passage. This assures a uniform continuous drive of the head assembly 21 regardless of the volume of water which is being dispensed from the nozzle 60. Since the water flowing through the motor 40 is also ejected through the nozzle 60, there will always be a minimum discharge of water from the nozzle (when water is supplied to the sprinkler 20); and this water which flows through the motor 40 may provide a minimum circular watering area, three feet in radius for example, even when the control valve is completely closed.

Figure 6:
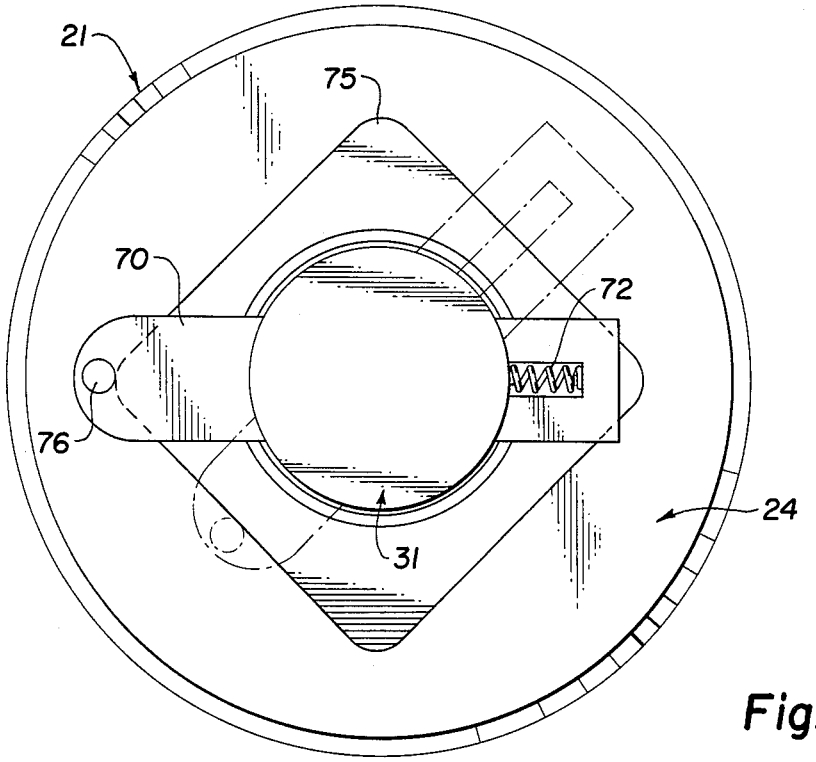
FIG. 6 is a top view of the sprinkler of FIG. 3.
Figure 7:
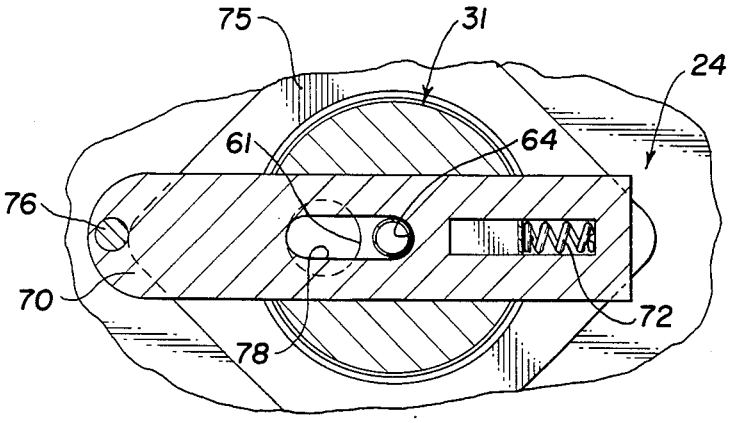
FIG. 7 is a sectional view taken along the line 6—6 of FIG. 3.

The valve and associated control mechanism for controlling the flow of water from the nozzle 60 is best seen in FIGS. 3, 6 and 7. The valve closure member 70 consists of an elongated member, rectangular in cross section, which is reciprocable within a transverse passage 67 in the head 31, which passage intersects and completely bridges the water flow passage 61 to the nozzle 60. The valve closure member is received closely within this passage 67 so that it may completely seal the water flow passage 61 in a closed position of the valve. The closure member 70 is shown in the fully open position in FIGS. 3, 6 and 7, and in a partially opened position in the phantom line position illustrated in FIG. 6. Spring biasing means associated with the closure member, normally urges the closure member to the right in FIG. 3, that is toward the position which will either restrict or cut off the flow of water through the flow passage 61. The closure member is provided with an elongated slot 71 for containing a biasing spring 72 in the form of a helical compression spring; and this spring is retained between the outer end wall of the slot 71 and a spring retainer 73. The spring retainer 73 consists of an elongated plate which extends through the closure member slot 71 and is seated in recesses 74 in the wall of head 31 at opposite sides of the valve passage 67. The spring retainer and the outer slot wall are both provided with centering bosses to confine the spring within the slot 71.

The valve slot 67 and valve closure member 70 are spaced from the upper wall of the upper housing 24; and a cam 75 in the form of a flat annular member is secured to that upper surface of the upper housing 24. The cam 75 may be fabricated from a plastic material for example, to provide for ease of forming the cam to the desired configuration; and the cam may be located on the upper housing by means of suitable coacting locating recesses and bosses. The cam may be secured to the housing by means of a suitable cement for example; and the indexing recesses and bosses are provided to assure that there will be no relative rotational movement. The peripheral edge surface of the cam 75 is formed to provide the desired cam surface which is engaged by a follower pin 76 projecting downward from the valve closure member at one end. The biasing spring 72 urges the follower pin in continuous engagement with the peripheral cam surface.

The closure member is provided with a flow control port 78 in the form of an elongated slot, as best seen in FIG. 7; and this slot is dimensioned to allow passage of the tube 64 which is a part of the independent water flow passage between the motor 40 and the nozzle 60.

The illustrated cam 75 is square in outline, having rounded corners to facilitate the following of the cam follower pin 76; and this cam is designed to program the sprinkler 20 to water a square lawn area such as is illustrated in FIG. 1. To effect the appropriate coverage of this area, the cam 75 must be oriented on the sprinkler 20 such that the straight edges of the cam are parallel to the straight edges of the square lawn area. For the watering of an L-shaped lawn area such as is illustrated in FIG. 2 of the drawing, an appropriate cam would have a corresponding shape and the cam would be oriented on the sprinkler 20 with its straight edges parallel to corresponding straight edges of the lawn area.

Referring particularly to FIGS. 3 and 7, it will be seen that the closure follower pin 76 is engaging a cam surface furthest from the axis of rotation of the head assembly 22, and that the valve closure is fully open allowing maximum flow of water to the nozzle 60. The water flow from the nozzle then would be at 100% to project the water stream the furthest distance and to project the maximum amount of water. As the head assembly 22 is rotated relative to the body 21 the closure member would move toward the right (in FIGS. 3 and 7) causing a smaller portion of the flow control port 68 to be exposed tc the flow passage 61, thereby reducing the water flow to the nozzle 60. It will be seen then that the valve closure member 70 on the associated cam control provide for direct control of the water flow through the nozzle 60 and in direct and proportional relation to the configuration of the lawn area to be watered. Should the cam configuration allow the closure member to move to the fully closed position, wherein no part of the valve port 78 communicates with the head passage 61, the head will continue to rotate and provide a minimum watering area around the sprinkler because of the water flow through the motor bypass passage which includes the tube 64.

Where desired, a set of cams may be provided for an individual sprinkler, or for each sprinkler of a system, to provide for different wind conditions. For example, one cam of the set may be designed for the no-wind condition, another cam of the set may be designed for an east wind of fifteen miles per hour, and another cam of the set may be designed for a west wind of fifteen miles per hour. With this kind of versatility, full and uniform watering of a lawn area is reasonably assured. The cams 75 may desirable be fabricated from a plastic material which is easily workable, that is which is easily shaped by the home owner to effect desired modification; and cam blanks may be provided by the manufacturer to enable the home owner or user to fabricate his own cams.

EMBODIMENT OF FIGS. 8 AND 9

Figure 9:
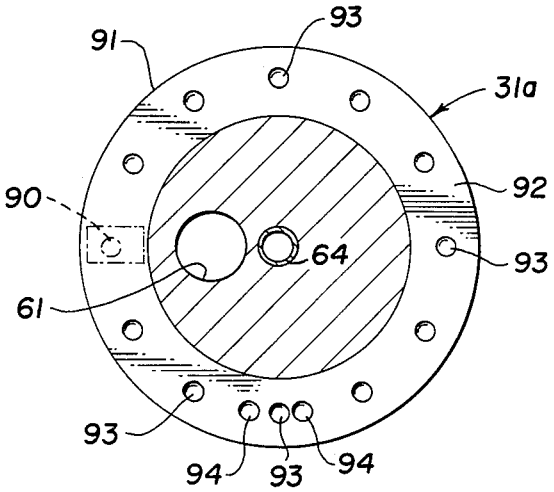
FIG. 9 is a sectional view taken along the line 9—9 of FIG. 8.
Figure 8:
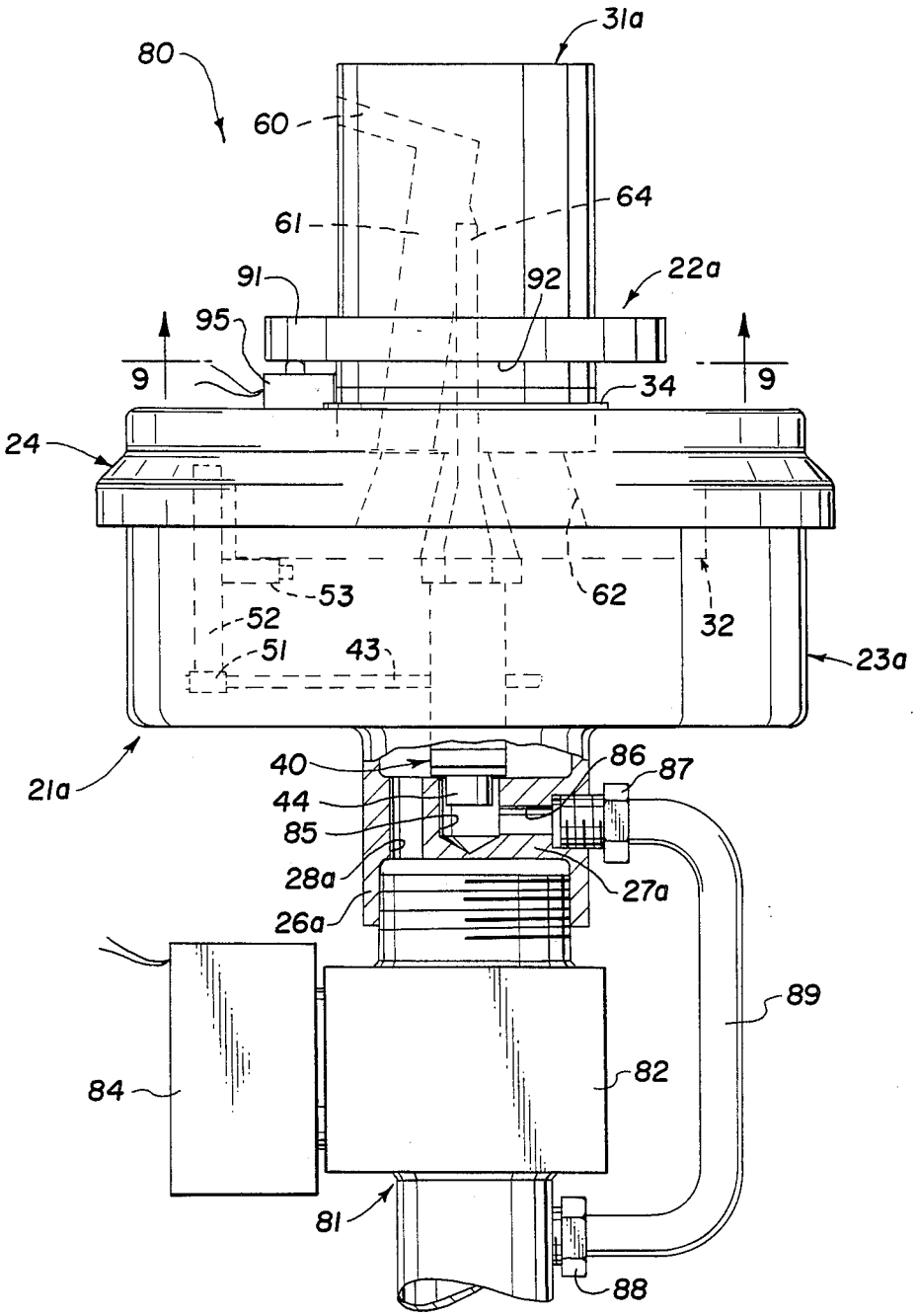
FIG. 8 is a side view c,f an alternative form of sprinkler according to the invention.

FIGS. 8 and 9 illustrate an alternative form of sprinkler according to the invention, which is adapted to be controlled remotely and which might be computer controlled. The sprinkler 80, best seen in FIG. 8, is very similar in structure to the sprinkler 20. In the following description, the same reference numbers will be used for the parts or structures which are identical to those of the sprinkler 20. In the sprinkler 80, the control valve is not located in the sprinkler head **22*a*, but rather in a separate unit attached to the inlet of the body 21*a*. The body and head include a coacting indexing structure to provide information to the remote control mechanism about the position of the head 22*a* relative to the body 21*a*. The body 21*a* differs from the body 21 only in the provision of a modified support structure for the water operated motor 40. The body includes a lower housing 23*a* and an upper housing 24 defining an interior chamber 25. The body includes an inlet neck 26*a* having a bridging support structure 27*a* for the motor 40, this support structure including passages 28*a* for the flow of water through the inlet into the chamber 25. The head assembly 22*a* includes a head 31*a* and the head gear 32; and is rotatably mounted within the opening 29 in the upper housing 24 by means of the bearing washer 33 and the retaining ring 34. The head assembly is rotatably driven by the drive mechanism including the water driven motor 40 including housing 41 containing impeller 42 nonrotatably mounted on the drive shaft 43. The reduction gear mechanism coupling the drive shaft to the head gear 32 consists of the pinion 51, large gear 52, and small gear 53**.

The head **31*a* includes the laterally directed nozzle passage 60 and generally vertical water supply passage 61 which is communicated with the body chamber 25 by means of generally vertical passages 62 in the head gear. The outlet flow passage for fluid from the motor 40 includes the axial passage 63 in the head gear and tube 64 mounted in an axial passage in the head 31*a* which communicates with the flow passage 61 and the nozzle 60**.

The principal water flcw to the nozzle 60 is controlled at the inlet to the body **21*a* by a control valve unit 81 which consists of a housing 82 threadedly coupled, for example, to the body neck 26*a*. The control valve unit may include, for example, a rotary control valve (not shown) for varying the flow of fluid through the unit into the body 23*a*, and an electric motor 84** for rotating the valve to the desired position.

In order to provide a continuous flow of inlet water to the water operated motor 40, the support structure **27*a* in the body neck 26*a* provides a recess 85 for receiving and seating the inlet boss 44 of the motor 40, and a lateral passage 86 communicating with the recess 85 and opening to the side of the neck 26*a* to receive a threaded fitting 87 for example. The housing 82 is provided with a port below the rotary valve 83 to receive a second threaded fitting 88; and a bypass conduit 89** is connected between these fittings.

With this control valve arrangement, the water flow may be varied in response to a predetermined program and may be under computer control. For such program control to be operative, the control must know the relative position of the head assembly 22*a* to the body 21*a*. For this purpose, the head 31*a* is provided with a radially extending, annular indexing flange 91, having a lower face 92 spaced from and confronting the upper face of the body housing 24. This lower face is provided with a plurality of indexing recesses 93 and 94 for coaction with the spring loaded follower member of an electric switch 90. FIG. 9 is a view of the lower flange face 92 and shows, by way of example, the relative locations of the recesses 93 and 94. Indexing recesses 93 are spaced apart equally around the periphery of the indexing flange 91, and may have an angular spacing of 30° for example. In order to establish a keying or starting point which may be recognized by the control mechanism, a pair of keying recesses 94 are placed closely adjacent to one of the recesses 93 on either side thereof. With this arrangement, the control mechanism will be able to identify when the nozzle 60 is directed in one certain direction (north for example) and will be able to identify the rotational position of the nozzle relative to north by counting pulses produced by the switch 90. Furthermore, if the keying recesses 94 are spaced unequally from the associated indexing recess 93, the control mechanism will be able to identify in which direction the head assembly 22*a* is rotating. In a remote control system of this type, desirably the water operated motor 40 will be provided with means for changing the direction of drive by remote control.

In this embodiment, an electric motor may be substituted for the water operated motor 40; and this may be appropriate since electric connection must be provided for the valve motor 84. The motor may be suitably encapsulated for waterproofing.

EMBODIMENT OF FIG. 10

Figure 10:
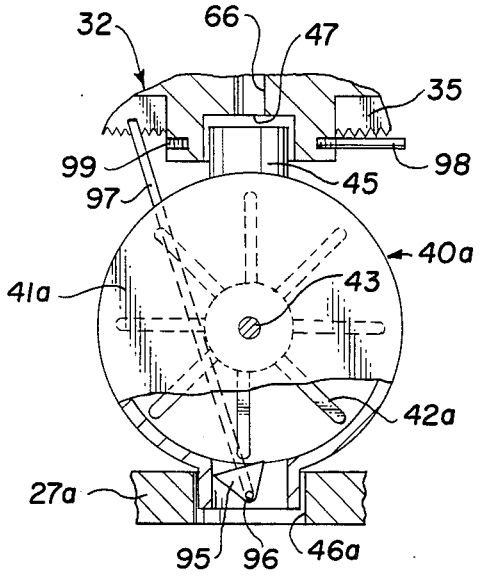
FIG. 10 is a fragmentary view, partially in section, of an alternative form of fluid operated motor.

FIG. 10 is a fragmentary view of a modified form of water operated motor 40*a*, and including a coacting control arm on the head gear 32. FIG. 10 shows fragmentarily the support structure for the housing of the motor 40*a*; and this support structure is the same as that shown in FIGS. 3 and 5, and having the same reference numbers. The water driven motor 40*a*, in FIG. 10, is adapted to be reversed in response to selected rotation of the head gear 32; and by this means the sprinkler 20 may be converted to an oscillating sprinkler wherein the head assembly would oscillate through an arc of 270° for example. This same oscillating motor structure and control might be inserted in the sprinkler 80; however, as already mentioned, it may be more desirable in a remote control sprinkler to also have remote control means for reversing the drive motor 40.

Referring to FIG. 10, which is a side view of the motor 40*a* somewhat similar to FIG. 5, the motor includes a housing 41*a* for housing an impeller 42*a* nonrotatably mounted on the drive shaft 43. The impeller is designed to be driven in either direction of rotation by the flowing water under control of a diverter to be described. The housing includes an inlet boss 44*a* and an outlet boss 45; and the housing is confined by these bosses in the associated support structure 27*a* of the lower housing 23 and the recess 47 of the head gear 32. A diverter 95 is mounted in the housing inlet 44*a* for oscillation about a pivot shaft 96. The diverter is oscillated between a first position illustrated in FIG. 10 wherein the inflowing fluid is directed to rotate the rotor counterclockwise, and a second position wherein the inflowing fluid is directed to rotate the rotor in a clockwise direction. The diverter may be nonrotatably mounted on the shaft 96, to which is also attached an operator arm 97 extending perpendicular to the shaft 96 and having a distal end positioned for engagement by a laterally extending control arm 98 mounted on the central hub portion of the head gear 32 which houses the central recess 47. The control arm 98 may be threaded at one end; and the head gear housing portion may contain a plurality of threaded recesses 99 spaced about the periphery of the hub portion so that one or more control arms may be mounted at selected angular positions on the head gear. Desirably, the operator arm 97 may be also controlled by some form of over center biasing device so that when the arm is moved past the center position toward one position or the other it will move fully to the new position and maintain that new position until it is urged again to the original position.

What has been described is a unique sprinkler which may be programmed to apply fluid uniformly to an area, such as a lawn area of irregular shape. In one form the sprinkler is pre-programed and completely automatic, and the sprinkler head may rotate continuously in one direction or may be constructed to oscillate back and forth to a selected angle. In another configuration the sprinkler head may be operated remotely, and possibly under the control of the computer program, where the program may be changed instantly to compensate for wind direction and velocity for example.

A feature and advantage of the self contained automatic sprinkler, is that the program is provided by cams which may be readily changed to change the sprinkler program. For example, if some structure is added to an area which might be damaged by spray, the program might be changed to prevent the spray from reaching that structure. Similarly, sets of program cams may be provided including for example one for a no-wind condition, and another for an average prevailing wind from a specific direction for example. A further advantage is that program cams may be provided which can be readily changed, and the cams modified by a home owner user.

An important feature and advantage of the invention is that it enables the watering of lawn areas for example which have irregular shapes such as elongated rectangular areas, L-shaped areas, or any other shaped area, and wherein each of these areas may be watered completely and uniformly. Areas of precise configuration may be watered without dispensing water beyond the peripheral areas where the water is possibly unwanted or will possibly be wasted.

A further feature and advantage of the sprinklers according to the invention is that an expansive lawn area may be watered with maximum uniformity and control. In a large rectangular expanse of lawn for example a grid of sprinklers may be provided each watering a square or rectangular section, and wherein each square or rectangular section will be watered by a single sprinkler without significant overlap. In this manner, each sprinkler waters its designated area to provide maximum uniformity of water application.

Sprinklers according to the invention may be used for any liquid dispensing operation where control of the peripheral extent of the liquid distribution is desired. One useful application may be in connection with sprinkler systems for fire prevention in buildings. In a warehouse or storage room, for example, where some valuable inventory is stored will be damaged by water, the sprinklers may be programmed to avoid particular floor areas where that valuable inventory is stacked.

An advantage of this invention is that a single sprinkler may be utilized to water the entire lawn of a residence, for example. A watering plan may be devised wherein the sprinkler may be placed at selected locations in the yard, and a cam designed for each designated location so that the sprinkler would water a preselected area when placed at that selected location and oriented properly. The user would then have a set of cams programmed for the several yard locations, which he would interchange in the sprinkler to effect the watering of his entire lawn.

While preferred embodiments of the invention have been illustrated and described, it will be understood by those skilled in the art that changes and modifications may be resorted to without departing from the spirit and scope of the invention.

What is claimed is:

1. A sprinkler comprising a body having a chamber, and a fluid inlet passage to said chamber;

a head rotatably mounted on said body, communicating with said chamber; said head having nozzle means for directing a fluid stream laterally relative to the axis of rotation thereof, and passage means communicating said nozzle means with said body chamber;

drive means including motor means for rotating said head relative to said body;

control valve means for varying the flow of fluid to said nozzle means;

coacting control means mounted on said body and said head, responsive to the rotation of said head relative to said body for controlling said control valve means;

said control means comprising a platelike cam mounted on said body and disposed perpendicular to said axis of head rotation; said platelike cam having a peripheral edge cam surface;

said flow control valve means comprising a valve slide mounted in said head adjacent to said platelike cam for reciprocation transverse to said axis of head rotation, said valve slide having a port coacting with said passage means for varying fluid flow in response to reciprocation thereof;

and said control means further comprising a cam follower mounted on said valve slide for coacting with said cam surface, and means urging said valve slide in a direction to maintain said cam follower in engagement with said cam surface;

flow passage means bypassing said flow control valve means for effecting uniform flow of fluid through said motor means; said motor means comprising fluid activated motor means.

2. A sprinkler comprising a body having a chamber, and a fluid inlet passage to said chamber;

a head rotatably mounted on said body, communicating with said chamber; said head having nozzle means for directing a fluid stream laterally relative to the axis of rotation thereof, and passage means communicating said nozzle means with said body chamber;

drive means including motor means for rotating said head relative to said body;

control valve means for varying the flow of fluid to said nozzle means;

coacting control means mounted on said body and said head, responsive to the rotation of said head relative to said body for controlling said control valve means;

said control means comprising a platelike cam mounted on said body and disposed perpendicular to said axis of head rotation; said platelike cam having a peripheral edge cam surface;

said flow control valve means comprising a valve slide mounted in said head adjacent to said platelike cam for reciprocation transverse to said axis of head rotation, said valve slide having a port coacting with said passage means for varying fluid flow in response to reciprocation thereof;

and said control means further comprising a cam follower mounted on said valve slide for coacting with said cam surface, and means urging said valve slide in a direction to maintain said cam follower in engagement with said cam surface;

said motor means comprising fluid actuated motor means to be driven by fluid passing into said body;

said fluid actuated motor means including a housing having an inlet and an outlet;

conduit means associated with said head for communicating said motor housing outlet with said head passage means, said conduit means bypassing said control valve means, whereby fluid flows through said fluid actuated motor means independently of said control valve means.

3. A sprinkler as set forth in claim 2 including said conduit means being disposed in the axis of rotation of said head; said conduit means defining bearing means for supporting said motor housing outlet.

4. A sprinkler as set forth in claim 2 including said conduit means including a tube disposed within said head and extending through said port of said valve slide.

5. A sprinkler comprising a body having a chamber, and a fluid inlet passage to said chamber;

a head rotatably mounted on said body, communicating with said chamber; said head having nozzle means for directing a fluid stream laterally relative to the axis of rotation thereof, and passage means communicating said nozzle means with said body chamber;

drive means including motor means for rotating said head relative to said body;

control valve means for varying the flow of fluid to said nozzle means;

coacting control means mounted on said body and said head, responsive to the rotation of said head relative to said body for controlling said control valve means;

motor means for driving said control valve means;

said control means including coacting indexing means mounted on said body and said head;

said indexing means including signaling means responsive to rotation of said head relative to said body for controlling the operation of said control valve motor means.

6. A sprinkler as set forth in claim 5 including said control valve motor means comprising electric motor means; said indexing means comprising peripherally spaced detent means mounted on said head;

and said signaling means comprising electric switch means mounted on said body, coacting with said detent means to transmit electric signals identified with respective said detent means.

7. A sprinkler as set forth in claim 6 including said head having keying detent means, associated with one of said indexing detent means, for coaction with said switch means to identify a selected rotary position of said head relative to said body.

* * * * *